United States Patent [19]

Hirata et al.

[11] Patent Number: 4,949,807

[45] Date of Patent: Aug. 21, 1990

[54] ENGINE EXHAUST MUFFLER APPARATUS

[75] Inventors: Makizo Hirata; Shinichi Tamba, both of Kakogawa; Akio Miguchi, Kobe, all of Japan

[73] Assignee: Kawasaki Jukogyo Kabushiki Kaisha, Kobe, Japan

[21] Appl. No.: 165,721

[22] Filed: Mar. 9, 1988

[30] Foreign Application Priority Data

Mar. 11, 1987 [JP] Japan ..... 62-35555

[51] Int. Cl.[5] ..... F01N 1/08

[52] U.S. Cl. ..... 181/240; 181/238; 181/265; 181/272

[58] Field of Search ..... 181/227, 228, 239, 240, 181/204, 269, 274, 272, 265

[56] References Cited

U.S. PATENT DOCUMENTS

| | | | |
|---|---|---|---|
| 2,513,229 | 6/1950 | Bourne et al. | 181/240 |
| 2,833,368 | 5/1958 | Lowther | 181/240 |
| 2,940,249 | 6/1960 | Gospodar | 181/240 X |
| 3,756,027 | 9/1973 | Gotoh et al. | 181/238 X |
| 3,827,529 | 8/1974 | Frietzsche et al. | 181/240 X |
| 4,133,479 | 1/1979 | Musitano et al. | 181/264 X |
| 4,416,350 | 12/1983 | Hayashi | 181/272 |

*Primary Examiner*—Benjamin R. Fuller

*Attorney, Agent, or Firm*—Marshall, O'Toole, Gerstein, Murray & Bicknell

[57] ABSTRACT

Muffler apparatus including an elongated muffler which is connectable to an engine body via two exhaust pipes. The muffler includes a first expansion chamber which extends along the entire length of the muffler, and the two exhaust pipes are connected separately adjacent opposite ends, or in the vicinity of the ends, of the muffler on the side of the muffler at which the first expansion chamber is located.

6 Claims, 2 Drawing Sheets

ENGINE EXHAUST MUFFLER APPARATUS

FIELD AND BACKGROUND OF THE INVENTION

This invention relates to the structure of an exhaust muffler for use in an engine having two exhaust ports for connection to the muffler.

For an engine having two or more cylinders, the muffler is generally connected to the engine body via either one or two exhaust pipes. To enhance the noise muffling effect, the muffler and the engine body are usually positioned so as to be separated by a certain distance. Then, by positioning such peripheral components as the carburetor, fuel pump, and coolant pump, and such hose as the fuel line and the coolant lines, or such covers as the fan housing, in the space between the muffler and engine body, a layout is achieved whereby the entire engine is compact.

In an engine wherein the muffler is connected to the cylinders via two exhaust pipes, the two exhaust pipes have been routed as most appropriate for each engine while considering the layout of the aforementioned peripheral devices or of the support frame, etc. The two exhaust pipes have always been connected to the muffler within an area of about one-fourth to three-fourths the overall length of the muffler.

However, with this type of muffler structure, because an arrangement was used wherein the muffler is supported on the engine body by the exhaust pipes, from the viewpoint of strength, the support of the muffler, which has a considerable amount of weight, by the two exhaust pipes connected at the center of the muffler, placed excessive demands on the strength of the joints between the exhaust pipes and the muffler body under the state of vibration which exists during engine operation, thus resulting in a reduction in the life of the exhaust pipes. In addition, the rigidity of the muffler and the exhaust pipe structure was low, thus resulting in an increased amount of noise caused by the resonance of the muffler and the exhaust pipes during engine operation.

Furthermore, because of the short distance which existed between the two exhaust pipes, the heat emanating from the exhaust pipes caused an undesirable increase in the temperature of the above-mentioned peripheral components, hose and covers. This especially led to the early deterioration of the parts made of rubber and covers made of plastic, etc.

Note that, although there are examples of prior art mufflers wherein first expansion chambers are provided at both ends of the muffler and the exhaust pipes are connected to the two ends, such as that shown in FIG. 7 herein, in this case, there was the drawback that, in order to provide the needed capacity of the two first expansion chambers and to handle the exhaust pipes, the overall length of the entire muffler, including the exhaust pipes was increased.

The main objective of this invention is to provide a muffler apparatus which avoids the problems described above, and for which the overall length of the muffler is relatively short without any loss in the noise muffling effect.

SUMMARY OF THE INVENTION

Muffler apparatus according to this invention includes an elongated muffler which is connected to the engine body via two exhaust pipes. The apparatus is characterized in that the muffler includes a first expansion chamber which extends along the entire length of the exhaust muffler, and the two exhaust pipes are connected separately at both ends, or in the vicinity of the ends, of the muffler on the side of the muffler at which the first expansion chamber is located.

Thus, an apparatus having the foregoing structure has increased strength because the muffler is supported on the engine body by the two exhaust pipes connected at the opposite ends, or in the vicinity of the opposite ends, of the muffler. In addition, because there is greater rigidity than in a conventional structure wherein the muffler was supported at the center, or in the vicinity of the center, vibration (especially resonance) of the muffler and the exhaust pipes during engine operation is reduced. Furthermore, when the structure of this invention is applied, as shown in FIGS. 5 and 6 herein for example, as the exhaust apparatus of a vertical-shaft V-type engine, because the distance between the two exhaust pipes is increased, and also because the two exhaust pipes connected to the engine body are positioned to the outside and away from the peripheral components so that the outward sides of the pipes are cooled by the ambient air, there is much less heat affecting the various peripheral components, hose and covers located between the two exhaust pipes; in other words, located in the space enclosed between the two exhaust pipes, the engine body, and the muffler.

BRIEF DESCRIPTION OF THE DRAWINGS

This invention may be better understood from the following detailed description of the drawings taken in conjunction with the accompanying figures of the drawings, wherein.

DETAILED DESCRIPTION OF THE DRAWINGS

Figure 1:
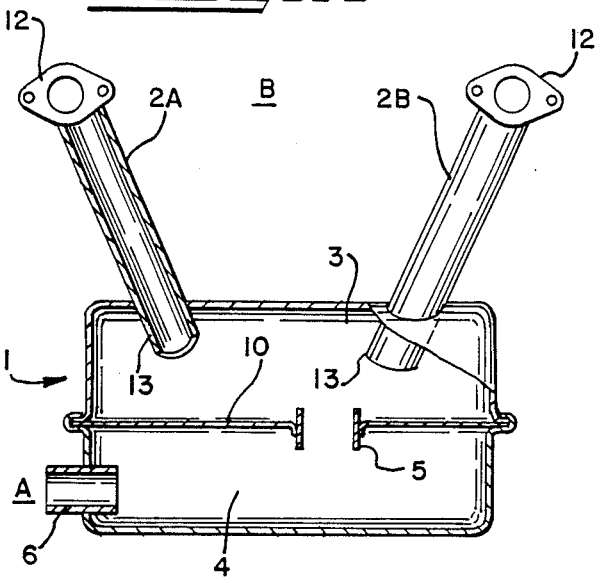
FIG. 1 is a view partially in section showing the structure of a muffler constructed in accordance with a first embodiment of this invention.
Figure 2:
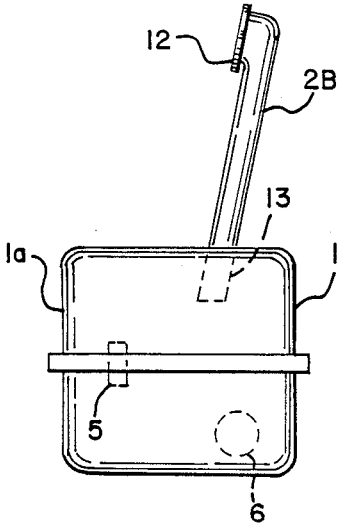
FIG. 2 is a side view of the muffler shown in FIG. 1.

FIGS. 1 and 2 illustrate a muffler 1 connected to exhaust pipes 2A and 2B. The muffler 1 includes a generally rectangular outer wall 1*a* and an interior partitioning wall 10 which extends across opposite sides of the wall 1*a*. The interior wall 10 and the outer wall 1*a* form a first expansion chamber 3 and a second expansion chamber 4, the two chambers being connected by a pipe or opening 5 in the interior wall 10. The numeral 6 indicates an exhaust pipe which connects the second expansion chamber 4 with the ambient air at the exterior A of the the muffler.

By providing the interior partitioning wall 10 lengthwise inside the muffler 1, the first expansion chamber 3 is formed by the outer wall 1*a* and the partitioning wall 10, and the two exhaust pipes 2A and 2B, one end of each of which is connected to the engine body (not shown in FIGS. 1 and 2) by flanges or couplings 12, are secured to the outer wall 1*a* and communicate with the first expansion chamber 3. The exhaust pipe 2A is connected to one end (the left end as seen in FIG. 1) of the muffler 1, and the exhaust pipe 2B is connected in the vicinity of the other end (the right end as seen in FIG. 1). As shown in FIGS. 1 and 2, the interior end portions 13 of the two pipes extend through the wall 1*a* and into the interior of the chamber 3. In addition, the first expansion chamber 3 and the second expansion chamber 4, which are separated by the partitioning wall 10 as mentioned above, are coupled by the connecting pipe 5 which passes through the center of the partitioning wall 10. Furthermore, the second expansion chamber 4 is connected to the ambient air A via the exhaust pipe 6 which passes through the outer wall from the second expansion chamber 4.

Thus, by connecting the exhaust pipes 2A and 2B to the muffler 1 at the positions described above, increased strength is provided because the muffler 1 is supported on an engine E (refer to FIGS. 5 and 6) at both ends. In addition, because the rigidity of the structure comprising the exhaust pipes and the muffler is also increased, the resonance is reduced.

Further, because of the relatively great distance between the two exhaust pipes 2A and 2B, not only can the separation between the exhaust pipes and other peripheral components be increased, but also the exhaust pipes 2A and 2B, which are thus positioned toward the outside and away from peripheral devices (not shown in FIGS. 1 and 2), come in contact with the lower-temperature outside air for better cooling. As a result, in addition to the temperature of the entire exhaust pipes being lower, the temperature of the muffler is also lower, and, because they are separated by a greater distance, the peripheral devices are less affected by the heat of the exhaust pipes. Thus, the peripheral devices (normally located in the area B shown in FIG. 1) which is enclosed between the exhaust pipes and the muffler are no longer exposed to high temperatures as they were in the past when using prior art structures.

Figure 3:
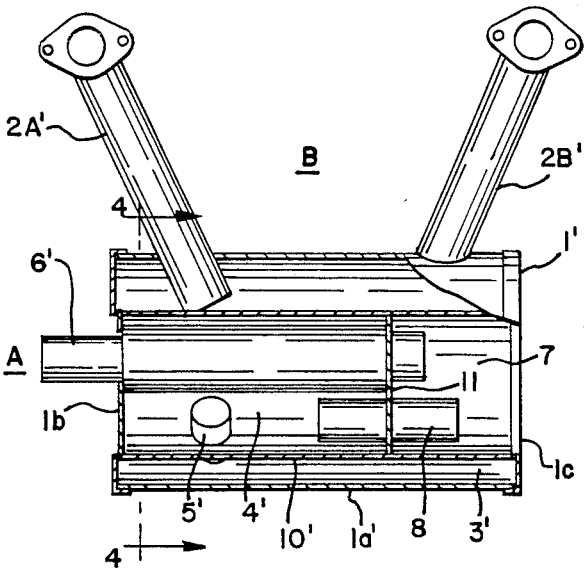
FIG. 3 is a view similar to FIG. 1 but showing a muffler in accordance with a second embodiment of this invention.
Figure 4:
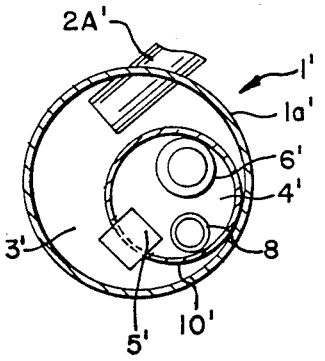
FIG. 4 is a view taken on the line 4—4 of FIG. 3.

Although the second embodiment shown in FIGS. 3 and 4 is basically the same as the first embodiment described above, it differs in the following respects. The interior partitioning wall 10′ of the muffler 1′ and the outer wall 1*a* have cylindrical configurations so that they form a double pipe (refer to FIG. 4). Together with the cylindrical outer wall 1*a* and the two flat end walls 1*b* and 1*c* of the muffler 1′, this partitioning wall 10′ forms the first expansion chamber 3′, which is on the outside of the interior wall 10′. In addition, this partitioning wall 10′ and the end wall 1*b* form the second expansion chamber 4′ within the interior of the wall 10′, which is partitioned by a radial partitioning wall 11. Furthermore, this partitioning wall 11, the partitioning wall 10′, and the other end wall 1*c* form a third expansion chamber 7.

The first expansion chamber 3′ and the second expansion chamber 4′ are connected by a connecting pipe 5′, and the second expansion chamber 4′ and the third expansion chamber 7 are connected by a connecting pipe 8. Also, the third expansion chamber 7 is connected to the outside air A by an exhaust pipe 6′ which passes through the partitioning wall 11, through the chamber 4′, and out through the end wall 1*b*.

The two exhaust pipes 2A′ and 2B′ are secured to the cylindrical outer wall 1*a*′ adjacent the opposite ends of the wall 1*a*′. The wall 1*a*′ is elongated as shown in FIG. 3 and the pipes are therefore separated, similar to the arrangement shown in FIG. 1.

As a result, although the basic operation of this embodiment is the same as for the first embodiment described above, the difference exists in that, because there is one more expansion chamber, the noise muffling effect is increased.

As best shown in FIGS. 1 and 3, the two exhaust pipes angle or slant upwardly and toward the ends of the muffler 1. The pipes connect with the muffler outer wall at distances from the outer ends which are substantially one-fourth the overall length of the muffler housing. Thus each muffler pipe supports approximately one-fourth the length of the muffler on each side of the connection between them, and the loads are balanced on opposite sides of both pipes. The angle at which the pipes slant upwardly is determined by the distance between engine exhaust ports of the engine housing (where the flanges 12 connect) and by the overall length of the muffler housing. The overall length of the muffler housing is approximately equal to the width of the engine (see FIG. 6); the height and width of the housing are approximately equal and are approximately 0.6 of the overall length of the muffler.

Figure 5:
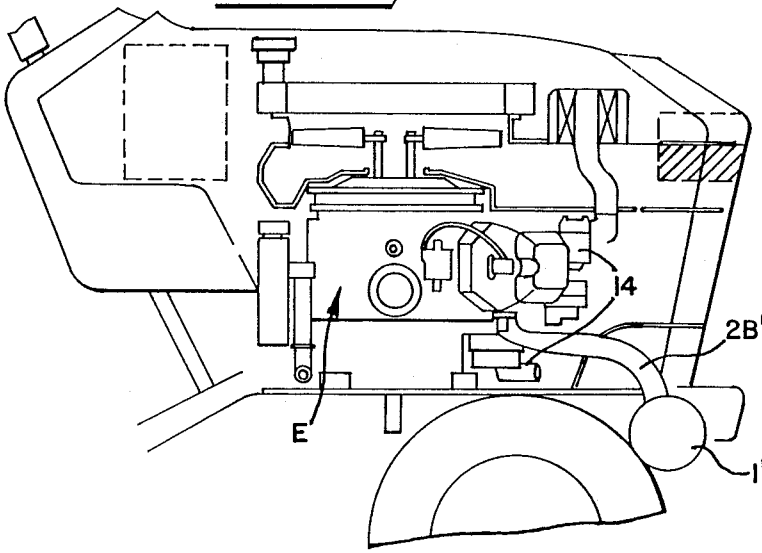
FIG. 5 is a side view showing an example of a muffler according to this invention installed in a work vehicle.
Figure 6:
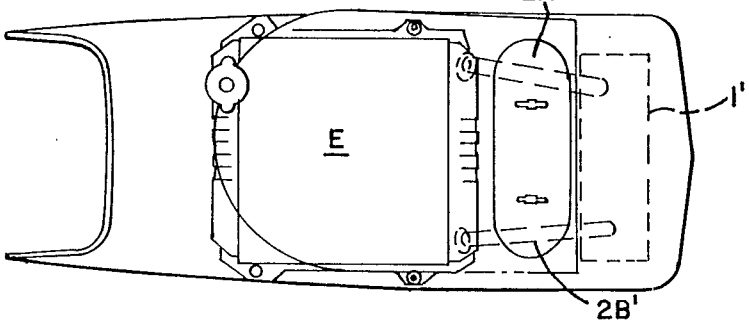
FIG. 6 is a plan view of the structure shown in FIG. 5.

FIGS. 5 and 6 show a wheeled vehicle including an engine E having a muffler apparatus in accordance with the invention. In this example, the engine is a conventional vertical-shaft V-type engine, and the engine exhaust ports are on the side of the engine housing which is adjacent the forward (to the right as seen in FIGS. 5 and 6) end of the vehicle. The muffler 1′ has a cylindrical housing as shown in FIGS. 3 and 4, and it is located forwardly and downwardly of the engine E. The exhaust pipes 2A′ and 2B′ angle downwardly and toward each other from the engine body. Engine components, indicated generally by the numeral 14, are located in the space between the pipes 2A′ and 2B′.

Figure 7:
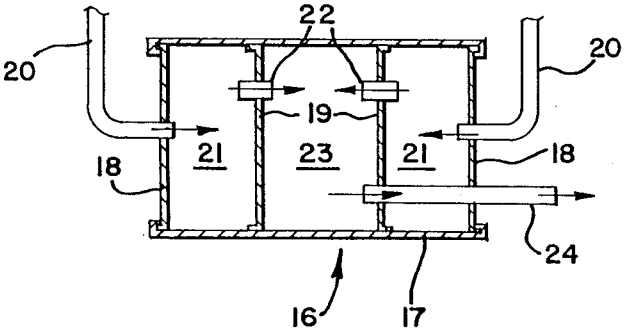
FIG. 7 PRIOR ART
FIG. 7 is a sectional view showing the structure of a prior art muffler.

FIG. 7 illustrates a prior art muffler apparatus 16 including an outer wall 17 (which may be cylindrical or rectangular), end walls 18, and two interior partition walls 19. Two exhaust pipes 20 extend through the end walls 20 and into two expansion chambers 21 which are separated. Two short pipes 22 connect the chambers 21 with an interior second expansion chamber 23, and another pipe 24′ connects the chamber 23 with the ambient air. In this arrangement the first expansion chambers 21 are separated, do not extend along the entire length of the muffler, and do not connect with both exhaust pipes 20. There is less rigidity (and therefore greater resonance) because the pipes 20 connect with the end walls 18 and not with the outer wall 17. In FIGS. 1 to 4, each exhaust pipe opens into a relatively large first expansion chamber, whereas in FIG. 7 each pipe 20 opens into a relatively small first expansion chamber. In FIGS. 1 to 4, the first expansion chamber is about one-half the interior volume of the muffler, whereas in FIG. 7 each chamber 21 is approximately one-third or less of the interior volume.

Because the muffler of this invention has the composition described herein, the fact that the muffler is supported at both ends, or in the vicinity of both ends of the outer housing wall, results in a considerable increase in the useful life, even though it is composed of pipes having the same dimensions and same materials as conventional mufflers. In addition, because the rigidity of the structure comprising the exhaust pipes and the muffler is increased, the resonance between the muffler and the exhaust pipes during engine operation is decreased, thus resulting in less noise. Furthermore, there is reduced deterioration of peripheral components, pipes, covers, etc., due to the heat of the exhaust pipes, which occurs with mufflers having a conventional construction.

What is claimed is:

1. An engine exhaust muffling apparatus comprising a muffler, two exhaust pipes attached to said muffler and adapted to be attached to an engine body, said muffler comprising an outer housing, an inner partition positioned within said housing and shaped to form an enclosed interior space, a first expansion chamber formed between said housing and said partition, said exhaust pipes being separately attached to said housing adjacent opposite ends of said housing and extending into said first expansion chamber, means forming second and third expansion chambers within said enclosed interior space formed by partition adjacent said ends, respectively, means connecting said first and second and expansion chambers together, means connecting said second and third expansion chambers together, and outlet means connected to said third expansion chamber and extending through said second expansion chamber.

2. An apparatus as set out in claim 1, wherein said first expansion chamber is larger than said second expansion chamber and said second expansion chamber is larger than said third expansion chamber.

3. An engine exhaust muffling apparatus as set out in claim 1, wherein said outer housing has a length, said exhaust pipes being connected to said outer housing at distances from opposite ends of said outer housing which are substantially one-fourth said length of said outer housing.

4. An engine exhaust muffling apparatus comprising a muffler, two exhaust pipes attached to said muffler and adapted to be attached to an engine body, said muffler comprising an outer housing, and inner partition positioned within said housing and entirely enclosed by said housing, said inner partition forming an enclosed interior space, a first expansion chamber formed between said housing and said partition and substantially surrounding said partition, said exhaust pipes being separately attached to said housing adjacent opposite ends of said housing and extending into said first expansion chamber, means forming second and third expansion chambers within said enclosed interior space formed by said partition adjacent said ends of said housing, means connecting said first and second expansion chambers together, means connecting said second and third expansion chambers together, and outlet means connected to said third expansion chamber.

5. An engine exhaust muffling apparatus as set out in claim 4, wherein said outer housing has an overall length and said two exhaust pipes are connected to said outer housing at distances from opposite ends of said outer housing which are substantially one-fourth the overall length of said outer housing.

6. An engine exhaust muffling apparatus as set out in claim 4, and further including outlet means connected to said third chamber and extending through said second chamber: and through said housing.

* * * * *